US006607084B1

(12) United States Patent
Spinelli

(10) Patent No.: US 6,607,084 B1
(45) Date of Patent: Aug. 19, 2003

(54) HOLDER ASSEMBLY FOR TUBULAR CONTAINERS

(76) Inventor: Sam Spinelli, 9877 NW. 26$^{th}$ Pl., Sunrise, FL (US) 33322

( * ) Notice: Subject to any disclaimer, the term of this patent is extended or adjusted under 35 U.S.C. 154(b) by 0 days.

(21) Appl. No.: 09/803,124

(22) Filed: Mar. 12, 2001

(51) Int. Cl.$^{7}$ ..... A47G 29/00
(52) U.S. Cl. ..... 211/70.01
(58) Field of Search ..... 211/71.01, 50, 211/10, 11, 40, 41.1

(56) References Cited

U.S. PATENT DOCUMENTS 1,415,110 A * 5/1922 Pearl
1,900,148 A * 3/1933 Wood
D160,344 S * 10/1950 Shapiro
D161,139 S * 10/1950 Shapiro
2,769,550 A * 11/1956 Rollins et al.
D201,733 S * 7/1965 Vovakes
3,557,965 A * 1/1971 Agerholm
3,754,646 A * 8/1973 Henig
4,163,497 A * 8/1979 McEwen
4,438,852 A * 3/1984 Evans ..... 211/11
4,507,330 A * 3/1985 Schaff ..... 211/41.1
D336,752 S * 6/1993 Lattimer
5,447,243 A * 9/1995 Graber
5,799,910 A * 9/1998 Dexter
D445,287 S * 7/2001 Kujala

* cited by examiner

*Primary Examiner*—Alvin Chin-Shue
*Assistant Examiner*—Sarah Purol
(74) *Attorney, Agent, or Firm*—Malloy & Malloy, P.A.

(57) ABSTRACT

A holder assembly designed to hold at least one but preferably a plurality of upstanding elongate tube-like containers or "squeeze tubes" in an upright position such that the labeling, directions, contents and other information formed on the exterior of the tube-like containers are clearly viewable regardless of the fact that some of the quantity of products has been exhausted from it. The holder assembly includes a base having an upper exposed face and a support portion disposed and configured for support of the base on a substantially horizontally oriented surface, wherein the base includes a gripping structure comprising spaced apart, elongated slots into which the closed or sealed end of the tube like-containers are removably inserted such that the containers extend upwardly and outwardly from the exposed face in the aforementioned position. The base includes a front face anti tilt foot and an opposite vertical face which is perpendicular to the upper face. The slots have a sufficient length so as to position the tube-like containers in rows corresponding to the position of the individual slots and in side-by-side relation to one another in the same slot.

4 Claims, 2 Drawing Sheets

HOLDER ASSEMBLY FOR TUBULAR CONTAINERS

BACKGROUND OF THE INVENTION

1. Field of the Invention

This invention relates to a holder assembly designed to removably support one or more tubular containers in a confined spaced, for example on a medicine cabinet shelf. More in particular, the holder assembly of the present invention is designed to hold one or more squeezable, tube-like containers of any size such as toothpaste, diaper ointment, etc. in an upright, substantially vertical, fully exposed position in order to store the various containers in a readily accessible position as well as to display the labeling, directions, informative indicia, etc. on each of the containers for clear viewing and identification.

2. Description of the Related Art

The use of squeezable, tube-like containers; or tubular containers, or "squeeze tubes" for the commercial packaging of a variety of products, such as toothpastes, ointments, hair gels, other gels, creams and lotions, etc. is extremely popular due in large part to the fact that these types of products are easier to dispense, in varying portions, utilizing the squeeze tube container. These squeezable, tube-like containers are typically formed from a plastic material and/or a metallic material such as heavy type of metal foil or light weight metallic sheet material, which have sufficient flexibility and ductility to allow the tubes to be squeezed by the hands and fingers of the user. However, such materials also have at least some degree of rigidity which provides sufficient structural integrity to the tube-like container to allow it to be oriented and maintained in somewhat of an upright position without collapsing or folding upon itself.

Containers of the type mentioned above are normally formed by extruding extremely long lengths of the plastic or other material into the tube shape on a continuous basis, wherein the individual containers are formed by cutting or severing the tubes to a specific length. Typically, one end of the cut tube segment is closed by forming a seam, which serves to seal that end into a generally flat, straight line configuration. The seam extends transversely across the width of the tube and provides a closed distal end through which the product, subsequent to the container being filled, cannot pass. The opposite end of the tube typically includes a dispensing opening, which is designed to be closed by an at least partially removable cap, stopper, or other closure structure. The product being packaged is, of course, disposed on the interior of the tube and is originally provided in quantities sufficient to expand the tube into an at least partially rounded cross sectional configuration.

As set forth above, the popularity of squeeze tube containers, is attributable to the ease and efficiency with which certain products, like toothpaste, gels or creams, may be dispensed. However, one universally recognized disadvantage of utilizing this type container is the appearance of these containers after a significant portion of the contents of the squeeze tube have been dispensed. More in particular, due to the semi-rigid and partially flexible nature of the material from which such containers are usually formed, the exterior shape of the container frequently becomes bent, wrinkled and/or at least partially folded, particularly when a majority of the contents has been removed therefrom, and must be further bent and/or folded in order to remove more of the tube's contents for additional use. Therefore, in order to improve the overall appearance of squeeze tube containers, as well as assure the removal of additional contents therefrom, it is common practice for the user to fold or roll the distal, closed end of the tube about itself. Such folding or rolling will continue along the length of the tube as the product continues to be dispensed.

While this rolled or folded configuration may at least minimally improve the appearance of partially used, squeeze tube containers, there still exists a significant disadvantage relating to identifying the contents or otherwise recognizing informative indicia printed on the labeling or exterior of the tube. Since many of the tube-like containers are similar in both size and configuration, it is a common occurrence to mistake the identity of the product intended for use, particularly when at least a significant portion of the length of the tube is rolled or folded upon itself, in the aforementioned commonly stored configuration. The mistaken identity and dispensing of products is not only inconvenient but could also be dangerous, particularly in light of the fact that some products such as toothpaste, which are to be orally administered, are frequently packaged in tube-like containers. Therefore, confusing another product, which would be harmful if placed in the mouth or swallowed, with toothpaste could result in injury to the user.

Accordingly, there is a long felt need in the art for a holder assembly designed to store one or more tube-like containers, such as squeezable tubes of toothpaste, hair gel, creams and the like, in any one of a variety of convenient locations. Any such holder assembly should be capable of orienting each of the one or more squeezable tubes in an extended, upright and substantially vertical position regardless of whether the contents have been partially dispensed or not. Further, the removable support and orientation of the squeezable tubes by any such holder assembly should be such as to readily expose all or a significant majority of the length of the tube in a manner which will allow the labeling, directions and/or other informative indicia to be readily viewed, in order that squeeze tubes, containing different products, but having similar dimensions and configurations, will not be inadvertently mistaken for one another. In addition, any such improved holder assembly should be sufficiently versatile, from a structural standpoint, to removably support a plurality of squeeze tubes of varying sizes, in the aforementioned upright, readily viewable orientation.

Also, for the sake of good order, this invention is needed for small apartment bathrooms which usually have a small wall cabinet with a mirrored outer surface and a relating small shape. This device provides a compact organizer for an array of unsightly tubes on the wash basin stand.

SUMMARY OF THE INVENTION

The present invention is intended to address these and other needs in the art and is, therefore, directed towards a holder assembly designed to removably support at least one, but most preferably, a plurality of tube-like containers, more commonly known as "squeeze tubes", which contain and facilitate dispensing of products in the form of creams, pastes, gels, lotions, etc. In addition, the holder assembly of the present invention is designed to orient a plurality of the squeeze tubes in a substantially vertical, upright orientation, such that the labeling and/or outer exposed surface of the tube is clearly exposed to facilitate viewing thereof, and thereby, avoid mistaking the identity of the packaged products.

More specifically, the holder assembly of the present invention comprises a base which in the preferred embodiment, may be formed of a solid, one piece construction from a variety of materials such as, but not limited to, wood. Alternatively, the base may be molded or otherwise formed from a plastic material, and ideally, one having a one piece unitary construction. In the latter embodiments, the interior of the base may be at least partially hollow, and a support portion of the base, normally defined by an underportion thereof, may have an at least partially open face. The base preferably also comprises an outer, exposed face which is substantially oppositely disposed to the support portion. The base is designed to be removably mounted on a substantially horizontally oriented support surface and may have a somewhat elongated overall configuration. The size and configuration of the base may vary, however, dependent upon the intended positioning of the base and/or the number of tube-like containers intended to be stored. The holder assembly of the present invention is, therefore, readily adaptable for positioning in a variety of locations or enclosures where products packaged in tube-like containers, of the type set forth herein, are typically stored.

The holder assembly of the present invention additionally includes a gripping structure for the removable, supporting engagement of one or more squeeze tubes. The gripping structure may be connected or coupled to the base, but preferably, is formed in and as part of the base. The gripping structure comprises at least one, but preferably, a plurality of slots formed in the exposed face of the base and extending along at least a majority of a length of the base. Each of the one or more slots comprises an open side disposed contiguous to the exposed face of the base. Further, each slot extends inwardly, into the interior of the base in an orientation which is at least transverse to the plane of the exposed face and preferably substantially perpendicular thereto. Each of the one or more slots preferably has a closed inner bottom or side and comprises a depth which is at least sufficient to receive and at least partially enclose the closed, sealed end of the squeeze tube. In addition, the width of the slots, along at least a portion of the respective lengths thereof, are such as to be disposed in removable, sliding and supporting engagement with substantially oppositely disposed sides or surfaces of the squeeze tube adjacent the sealed end thereof. Accordingly, the dimension and configuration of the one or more slots, along with the semi-rigid material from which the various tube-like containers are formed, allow the containers to be supported in a substantially vertical, upright orientation as they extend outwardly from the exposed outer face of the base in which the one or more slots are formed.

Therefore, the holder assembly of the present invention includes structural features which overcome the disadvantages associated with the use, identification, and storage of products packaged in squeeze tubes, by orienting the tube-like containers in an organized fashion, in a readily accessible location and in a manner which does not obscure the labeling or informative indicia present on the outer surface of the tube. Additionally considering the fact that tubular containers have a high center of gravity, the device has been provided with a foot structure to resist tilting or tripping over and falling from a shelf on the longitudinal extending front face and to conserve space on a small narrow surface, end faces and a rear face which are perpendicular to the bottom and top surfaces and can fit closely against the walls of a bathroom, these surfaces comprising abutment surfaces to engage such walls.

This and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
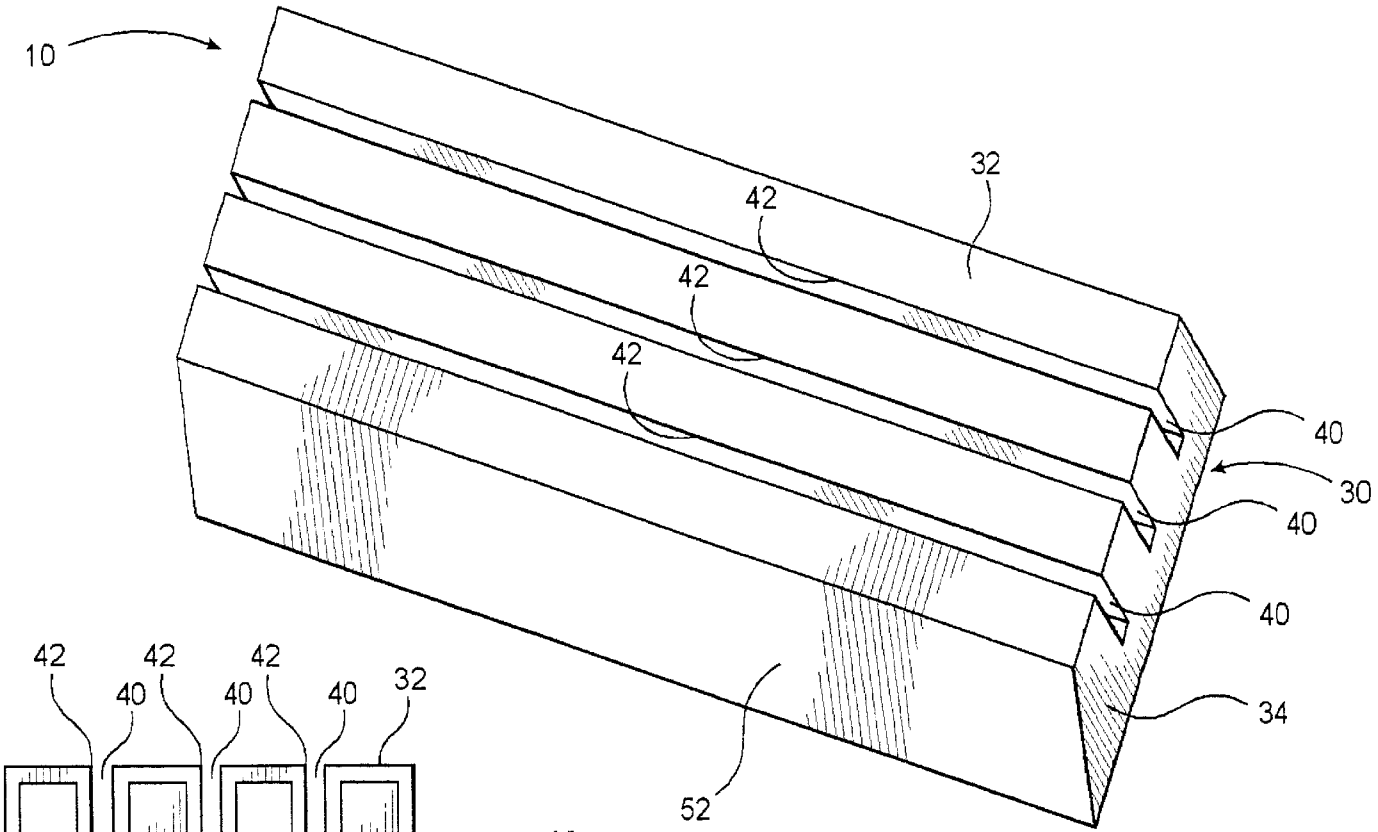
FIG. 1 is a perspective view of the holder assembly of the present invention in a first preferred embodiment with front and rear surfaces and a pair of end faces.

As shown in the accompanying drawings, the present invention relates to a holder assembly, generally indicated by reference numeral 10, of the type designed to hold at least one, but preferably, a plurality of tube-like containers.

Figure 3:
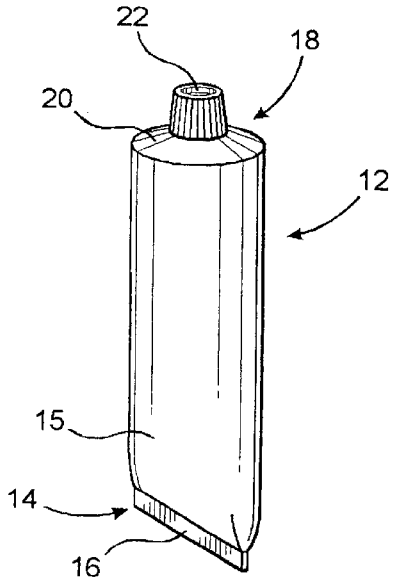
FIG. 3 (PRIOR ART)
FIG. 3 is a perspective view of a prior art, tube-like container or "squeeze tube" of the type intended to be removably supported by the holder assembly of the present invention.

A typical tube-like container, which is well known in the art and not a part of the present invention, is illustrated in FIG. 3 and is generally indicated by reference numeral 12. The tube-like container 12 carries fluid-like contents that can be dispensed by squeezing the container, and thus, may be more commonly known as a "squeeze tube." As illustrated in FIG. 3, squeezable containers 12 typically include an elongated, substantially tubular configuration having a closed end 14 including a seam 16 serving to seal the closed end 14 in order to prevent the escape of any of the contents therefrom. The opposite end of the squeeze tube 12 is generally indicated as 18 and includes a closure structure 20 having a dispensing opening 22 which may be covered or closed by an at least partially removable cap, stopper, etc. which is represented as 24 on the different squeeze tubes 12 of FIG. 4. The squeeze tube 12 is normally formed from a semi-rigid yet flexible material such as plastic, a bendable metallic material, etc. which is capable of being easily compressed or squeezed by the fingers and hand of a user and/or folded upon itself as the contents thereof are removed. At the same time, however, the material from which a majority of the tube-like containers 12 are formed have sufficient rigidity to enable them to be supported in a substantially upright, at least partially vertical orientation, as represented by the plurality of tube-like containers 12 shown in FIG. 4.

Figure 2:
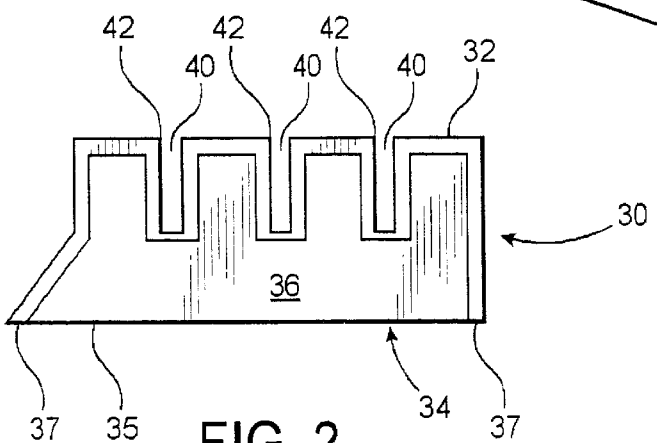
FIG. 2 is an end view interior of another embodiment of the holder assembly of the present invention, which does not have end faces.
Figure 4:
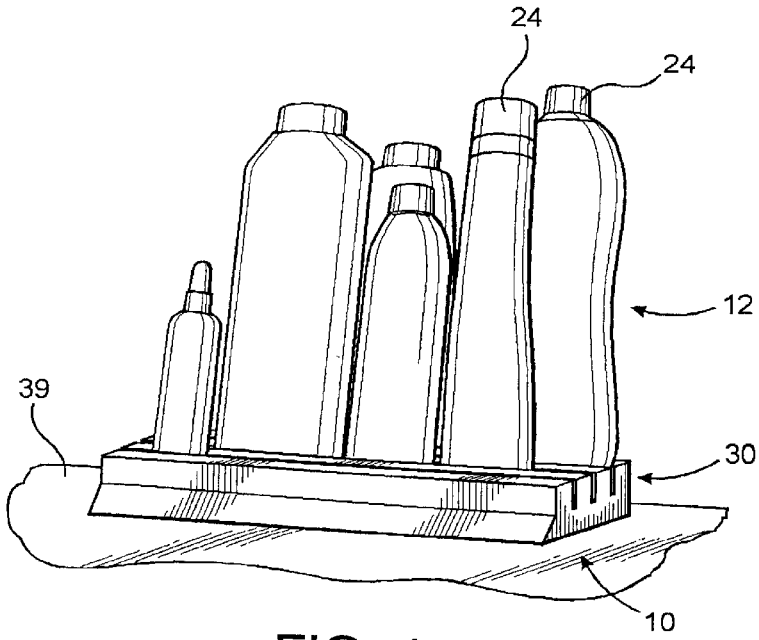
FIG. 4 is a perspective vie of a plurality of tube-like containers, of the type shown in FIG. 3, removably supported in an upright, clearly viewable position on or within the holder assembly of the present invention.

Accordingly, the holder assembly 10 of the present invention comprises a base, generally indicated as 30 in FIGS. 1 and 4. The base 30 preferably includes an upwardly facing exposed face 32 and a lower support portion 34, seen in FIGS. 2, and 5. The base 30 is preferably, but does not have to be formed from a one piece, substantially unitary construction, such as by molding or otherwise forming a plastic material. In such an embodiment, and as shown in FIG. 2, the base 30 can include an at least partially hollow interior 36 wherein the support portion 34 is defined at least in part by an open face, as at 35, with a surrounding peripheral surface 37. Accordingly, the support portion 34, including the open face 35 and the surrounding peripheral surface 37 is designed to be removably mounted or supported on any type of a large variety of preferably, horizontally oriented support surfaces, such as a counter-top or a shelf within a medicine cabinet, as shown by 39, in FIG. 4.

Figure 5:
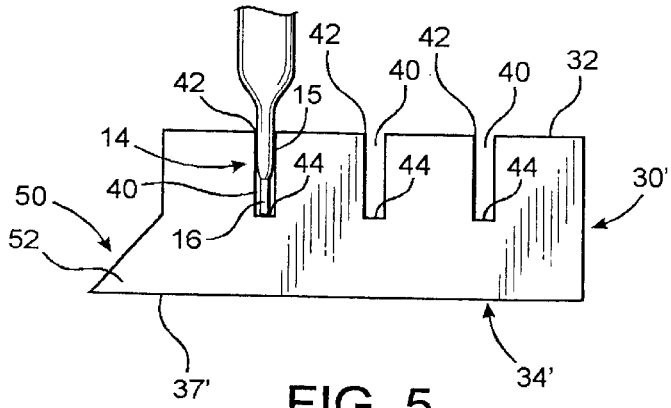
FIG. 5 is an end view of the base and holder according to the embodiment of the present invention seen in FIG. 1.

Another embodiment of the base 30 is shown in FIG. 5, and is represented as 30'. In this embodiment, the base is formed from a solid material such as wood, plastic, ceramic, clay or any other applicable material and is also preferably of a substantially one piece or unitary construction as shown. The bases 30' includes a support portion 34' having a substantially planar or flat surface configuration 37' which facilitates the removable positioning of the base on a substantially horizontally oriented support surface, 39, described above. In addition, a preferred overall configuration of the holder assembly 10, and in particular, the base 30 is an elongated somewhat rectangular configuration so as to facilitate positioning of the base 30 or 30' on a narrow shelf, such as of the type found on a medicine cabinet.

The holder assembly 10 of the present invention additionally includes a gripping structure comprising at least one, but preferably a plurality of slots 40. The gripping structure may be connected or otherwise coupled to the base 30, but in a preferred one piece construction, the gripping structure and slots 40 are integrally formed in the base 30 and extend from the exposed face 32 inwardly into the interior, towards but in spaced relation to the support portion 34. More specifically, and as clearly illustrated in FIGS. 2, and 5, each of the one or more slots 40 has an open end 42 formed contiguous to the outer exposed face 32 of the base, and each of the one or more slots 40 extend inwardly in a transverse and preferably, in perpendicular relation to the plane of the upper exposed face 32. While the one or more slots 40 do not have to assume a true 90 degree, perpendicular orientation, the orientation of the slots 40, relative to base 32, should be such as to facilitate the maintenance of each of the plurality of elongate squeeze or relating tall tubes 12 in the preferred, upright and somewhat vertical orientation as demonstrated in FIG. 4, regardless of the quantity of product remaining on the interior of the individual squeeze tubes 12. Each of the slots 40 also has a closed bottom or inner most side as at 44, which may have any of a variety of configurations so as to facilitate the receipt and removable support of the closed end 14 of any of the tube-like containers 12 placed therein. It will be appreciated the relatively tall tubes can be easily tipped over because of a high center of gravity.

The depth of each of the slots 40 is such as to receive and at least partially enclose the closed end 14, including the seam 16 therein. In addition, the width of each of the slots is such that opposite interior surfaces thereof are disposed in sliding, removably supporting engagement with oppositely disposed surfaces adjacent to or defining the closed end 14, as at 15. By virtue of this removable, supporting engagement, and also at least partially due to the semi-rigid nature of the material from which each of the squeeze tubes 12 is formed, the squeeze tubes 12 are maintained in a substantially upright, vertically oriented position as best shown in FIG. 4. In particular, the upright orientation of the removably supported squeeze tubes 12 is such as to allow substantially complete exposure of the labeling and informative indicia present on the exterior surfaces of the various tubes 12, in order to facilitate identification thereof.

Another feature of the present invention is the provision of a stabilizing portion shown in the embodiment of FIGS. 2 and 5. This is important to avoid tapping when loaded with tubular containers characterized by a high center of gravity. More specifically, the stabilizing portion, generally indicated as 50 in FIG. 5, includes an outwardly flared portion 52 extending along at least one of the opposite longitudinal sides of the base, and preferably, at least along a front side thereof as shown. The stabilizing structure 52 more specifically extends from the under-surface 37, and 37' of the support portion 34 and 34', inwardly and upwardly in a somewhat convergent orientation as it is aligned towards the exposed face 32. The stabilizing structure 50 thereby serves to facilitate the stable positioning of the base 30 when a plurality of the squeeze tubes 12 are arranged thereon in a collective orientation of the type shown in FIG. 4. It should also be noted that the opposite or rear face is vertical and together with an end face provides right angularly arranged abutment planes to engage the vertical wall surfaces along the rear and end face of a medicine cabinet shelf.

With reference primarily to FIGS. 1 and 4, when a plurality of the slots 40 of the gripping structure are integrally formed within the base 30, 30', etc. they are disposed in spaced apart relation to one another and preferably in a substantially parallel relation to one another. In addition, the length of at least some, and preferably all of the slots 40 is such as to allow at least 2 or more of the squeeze tubes 12 to be arranged therein in a side-by-side orientation as pictured in FIG. 4. The slots 40 extend along the entire length of the base 30. In this embodiment, a plurality of squeeze tubes 12 may be arranged in a plurality of rows, wherein each row is defined by a different one of the slots 40 and in a side-by-side orientation, as set forth above.

It should also be apparent that the one or more slots 40 are specifically dimensioned, as set forth above, to removably support a plurality of the squeeze tubes 12 in the aforementioned substantially upright orientation, wherein the squeeze tubes 12 may vary significantly in dimension and configuration in terms thickness, width, height, etc. Accordingly, the overall configuration and dimension of the base 30, and 30' may also vary to accommodate a different number of differently sized squeeze tubes 12. The embodiment includes the base being approximately at least about 6 inches in length and having a width of at least about 2½ inches at the upper exposed face 32, to approximately 3 inches at the outwardly flared, stabilizing member 52 to accommodate any manufactured medicine cabinet. The rear wall is vertical with respect to the upper face 32. Also, this embodiment can be set in any other desired place for the user's convenience. Further, the width of each of the slots 40 may be approximately ⅛ of an inch and have a depth of approximately ½ inch or other depth sufficient to receive and at least partially enclose the closed end 14 of tube-like container 12, in the manner described above. The spacing between the various slots 40 may generally be approximately ⅜ inch, dependent on the number of slots formed in the base as well as the overall size of the base.

The device is preferably of molded plastic material in the rigid range in the case of the embodiment of FIGS. 1 and 5 and the embodiment of FIG. 2, which does not have end faces being open. The latter embodiment permits the devices to be severed from an extended length, while the former embodiment is of a molded plastic piece.

Now that the invention has been described.

What is claimed is:

1. A holder assembly structured to support and facilitate access to a plurality of tube-like containers within a confined space, said assembly comprising:

a) an elongated base including a hollow interior terminating in an open face, said base further including a support portion peripherally surrounding said open face and disposed in supported engagement on a horizontal surface of the confined spaced, b) a gripping structure secured to said support portion and comprising an outwardly exposed face oppositely disposed to said open face and a plurality of elongated slots extending in parallel relation to one another along the length of said base, c) each of said plurality of slots extending from said outer exposed face into said hollow interior of said base, each of said slots having a sufficient depth and width to removably receive and at least partially enclose a sealed end of a plurality of vertically oriented tube like containers in side by side relation to one another along the length of said base, d) a front face and a rear face formed on said base and extending along the length thereof in opposing relation to one another, e) said front face comprising an anti-tilting foot at least partially defined by an outwardly flared configuration extending from said support portion upwardly and inwardly towards said gripping structure, f) said rear face comprising a vertical orientation disposed substantially perpendicular to said open face and in confronting relation to a vertical boundary of the confined space, and g) said base, said gripping structure and said support portion comprising a one piece, unitary construction of molded plastic material, said plurality of slots being integrally formed in said base.

2. A holder assembly as recited in claim 1 wherein said base includes a thickness between said exposed face and said support portion being of a greater dimension than a depth of said plurality of slots.

3. A holder assembly as recited in claim 2 wherein each of said plurality of slots comprises an open longitudinal side extending continuously along the length of said base and disposed in coplanar relation with said exposed face, each of said plurality of slots extending substantially perpendicular from said exposed face inwardly into said base.

4. A holder assembly as recited in claim 3 wherein said plurality of slots collectively extend continuously from said front face to said rear face and in substantially parallel relation to said front and rear face.

* * * * *